United States Patent [19]

Takemura et al.

[11] 4,388,113

[45] Jun. 14, 1983

[54] METHOD OF PREVENTING DAMAGE OF AN IMMERSED TUYERE OF A DECARBURIZATION FURNACE IN STEEL MAKING

[75] Inventors: Yozo Takemura, Tokyo; Isao Kobayashi, Tokai; Yasuhiro Akita, Chita; Kaoru Kato, Tokai, all of Japan

[73] Assignee: Nippon Steel Corporation, Tokyo, Japan

[21] Appl. No.: 305,259

[22] Filed: Sep. 24, 1981

[30] Foreign Application Priority Data

| | | | |
|---|---|---|---|
| Sep. 26, 1980 | [JP] | Japan | 55-133966 |
| Sep. 26, 1980 | [JP] | Japan | 55-133967 |
| Sep. 26, 1980 | [JP] | Japan | 55-133968 |
| Feb. 23, 1981 | [JP] | Japan | 56-25161 |

[51] Int. Cl.[3] ..... C21C 7/00; C21B 7/10

[52] U.S. Cl. ..... 75/51; 75/52; 75/59; 75/60; 266/46; 266/47

[58] Field of Search ..... 75/51, 52, 59, 60; 266/46, 47

[56] References Cited

U.S. PATENT DOCUMENTS

| | | | |
|---|---|---|---|
| 2,950,186 | 8/1960 | Allard | 75/60 |
| 2,979,395 | 4/1961 | Kosmider | 75/60 |
| 2,991,173 | 7/1961 | Trentini | 75/60 |
| 3,771,998 | 11/1973 | Knuppel | 75/52 |

*Primary Examiner*—P. D. Rosenberg

*Attorney, Agent, or Firm*—Pollock, Vande Sande & Priddy

[57] ABSTRACT

In bottom blown oxygen steel making or in top and bottom blown combined oxygen steel making, a tip end of a tuyer immersed in molten steel is seriously damaged or melted away due to very high temperatures due to the vigorous combustion of carbon, manganese and so on by the oxygen blown into a furnace.

In order to prevent such damage, hydrocarbon gas has been blown through space between an outer pipe and an inner pipe of a dual pipe tuyere or tuyeres, but such hydrocarbon gas rather excessively lowers the temperature of the molten metal adjacent to the tip end of the tuyere and often blocks the opening of the tuyere.

Now, instead of blowing in hydrocarbon gas, particulate material such as limestone magnesite, dolomite and the mixture thereof are proposed to be blown into the molten metal in the decarburization steel making vessel carried by an innert gas, combustion gas, blast furnace gas, LD process gas and oxygen or a mixture of these gases.

Particulate material mentioned above, when blown into the molten metal, increases the momentum of the gas flow, enhances a shielding effect, against high radiation heat by fire point, or further forms either a kind of protective layer or deposit of refractory mineral material at the tip of the tuyere thereby effectively preventing damage of the tuyere and lengthens the service life of the refining vessel.

Addition of particulate material in continuously linearly or in stepwise manner has been proved to be effective for accomplishing the above-mentioned cooling and protecting effect of the particulate material.

35 Claims, 11 Drawing Figures

METHOD OF PREVENTING DAMAGE OF AN IMMERSED TUYERE OF A DECARBURIZATION FURNACE IN STEEL MAKING

BACKGROUND OF THE INVENTION

The present invention relates to a method of preventing damage to an immersed tuyere of a decarburizing furnace or a converter for use in an oxygen steel making process. More specifically, the invention is concerned with a method of preventing, the damage to an immersed tuyere often experienced during the steel making process in the oxygen steel making process in which molten pig iron is decarburized and refined into steel, by injecting a particulate agent together with a carrier gas into the molten pig iron.

DESCRIPTION OF THE PRIOR ART

Up until 1956, crude steel in Japan had been made mainly by the open hearth steel making process. Then, a new process called "top blown oxygen steel making process" was introduced to Japan. In this new process, molten pig iron is poured into a converter or vessel, instead of an open hearth, and pure oxygen is blown above the molten pig iron through a lance inserted into the vessel from the upper side so as to rapidly decarburize and refine the molten pig iron into steel. The process is commonly known as the "LD process," and was actually put into practice in 1957.

In this oxygen steel making process, pure oxygen gas is blown as a jet having high energy to provide a driving force for an oxidizing reaction by vigorously reacting with C, Si and Mn in the molten pig iron. The decarburization reaction is enhanced by the stirring action on the CO gas generated as a result of reaction of oxygen with C and by the stirring action of the jet flow of oxygen from the lance, to permit about eight times increase of the steel making efficiency as compared with the conventional process using an open hearth. This new process, in addition, makes it possible to produce steel materials of higher quality at a higher rate than the conventional open hearth steel making process.

For these reasons, this new process is taking the place of the open hearth steel making process. Nowadays, more than 80% of crude steel produced in Japan is made by the top blown oxygen steel making process.

The top blown oxygen steel making process, although it offers the above-described various advantages, still suffers the following problem. Namely, as the decarburization refining approaches to the end period of steel refining, the carbon content in the molten metal is successively lowered and reduces the rate of generation of CO as the product of reaction with oxygen in the molten metal, so that the stirring effect of the CO on the molten metal bath and slag is also weakened undesirably to lower the decarburization efficiency of the oxygen thereby to proceed the oxidation of iron beyond the equilibrium value, resulting in making the subsequent dephosphorization difficult to perform.

As a measure for enforcing the stirring, it has been proposed to blow oxygen into the molten metal bath from the bottom of the furnace or a vessel or through a tuyere or a nozzle immersed in the bath. Excessive stirring, however, reduces the FeO content in the slag excessively to cause an insufficient slag formation. This countermeasure, therefore cannot suitably be used for the production of medium and high carbon steel. Rather, this countermeasure imposes a new problem of melting away of the refractory material of the tuyere by the high temperature generated as a result of reaction with oxygen.

In order to obviate this problem, it has been proposed to use a dual pipe tuyere having a central tuyere and an outer tuyere. The pure oxygen is injected from the central tuyere, while hydrocarbon gas is blown through the annular outlet space defined between the central and outer tuyeres, thereby to cool the tuyere by an endothermic decomposition of the hydrocarbon gas. This method was put into industrial use in 1968, as OBM method (Oxygen Bottom Blowing Method).

The U.S. Steel Company has developed a so-called Q-BOP method which is an improvement of the OBM method to make the latter suitable for low phosphor blowing. This Q-BOP method takes the advantage inherent in the bottom blown steel converter process over the top blown oxygen steel making process, and is now making rapid progress. The Q-BOP method, however, is not free from the problem of the damage of the furnace bottom peculiar in the bottom blow converter, and consumes a large amount of refractory material. Also, the use of hydrocarbon gas as the tuyere coolant inconveniently increases [H] in the molten steel due to the decomposition of the gas and incurs a defect in the product steel. It is possible to use $N_2$ gas in place of or in addition to the hydrocarbon gas. This, however, increases [N] in the molten steel to undesirably limit the amount to be blown. The use of argon gas or $CO_2$ gas also imposes problems such as increased cost of steel making. This problem becomes more serious as the amount of blowing is increased.

As a measure for making use of the advantage of both the top blown process and bottom blown process simultaneously, proposed a process which is referred to as combined top/bottom blown method.

In this combined method, it is possible to utilize the advantages of both processes provided that the rate of blow of the gas from the bottom blowing tuyere is adjustable over a wide range. As a matter of fact, however, if the rate of blowing gas from the bottom blowing tuyere is reduced down to a level below 50% of the design value, the molten metal inconveniently flows back into the tuyere. On the contrary, if the blowing is made in a large amount and at a higher blowing pressure, "spitting" becomes vigorous to make the operation practically impossible.

It has already been explained that OBM method and Q-BOP method have been proposed as improvements in the bottom blown steel converter process. Besides these methods, it has been proposed also to enhance the dephosphorization and desulfurization by blowing particulate solid material from the bottom blowing tuyere.

For instance, the British patent specification No. 820,357 proposes a dephosphorization refining process in which lime or other basic oxides and/or a dephosphorizing agent such as fluorite are blown into the furnace from the bottom of the furnace together with an oxidizing carrier gas.

Also, Japanese patent publication No. 11970/1974 discloses an invention relating to a refining method for refining a high phosphorous pig iron by making use of a bottom blown steel converter developed by Eisenwerk Geselschaft. More specifically, in this method, fine particulate lime is suspended by the oxygen gas and is blown together with a hydrocarbon gas as a jacket gas into the molten metal thereby to refine pig iron rich in phosphor.

Japanese Patent laid-open No. 89613/1976 discloses a technic which has been developed by U.S. Steel Company to further improve the Q-BOP method explained before. This technic aims at producing a low-sulfur steel by effecting a desulfurization before, after and during the decarburization conducted with a bottom blown steel converter. Briefly, this method can be said to add desulfurization blowing to the Q-BOP method. In the Q-BOP method, it is impossible to effect a satisfactory desulfurization when the carbon content is 3% or lower. In this improved method, however, it is possible to effect a desulfurization over the whole period of decarburization including the beginning, intermediate and end periods, by injecting a desulfurization agent such as lime, calcium carbide or the like from the bottom of the furnace together with a carrier gas which is an inert gas or an admixture of an inert gas and oxygen.

The above-explained improved bottom blown refining methods employing the blowing of particulate lime or the like from the bottom of the furnace belong to a common category of improved refining methods in which the dephosphorization or the desulfurization is enforced by particulate lime or the like blown into the furnace. Thus, in these methods, the particulate lime is considered and used as a dephosphorizing or desulfurization agent.

The bottom blown steel converter process is a process which has been developed to make up for the shortage of the stirring effect in the conventional top blown oxygen steel making process. In this method, if the pure oxygen solely is blown from the bottom, the bottom tuyere is rapidly melted away or damaged. In order to avoid this inconvenience, it has been proposed to use dual pipe tuyeres as stated before, so as to inject the oxygen from the central tuyere while injecting hydrocarbon gas as the jacket gas from the annular gas outlet between the outer and central tuyeres. This method, however, causes an undesirable rise of [H] in the steel, although it is effective in suppressing the melting away of the tuyere.

The present inventors have accomplished a series of inventions to obviate the above-described drawbacks or pending problem in the bottom blown steel converter process, and have filed patent applications on these inventions. In these preceding inventions, in order to avoid the shortage of the stirring force in the top blown oxygen steel making process while eliminating the excessive increase of the stirring power and the rise of [H] in steel in the Q-BOP method, the carrier gas is selected from a gas other than hydrocarbon gas, such as $O_2$, $CO_2$, $N_2$, Ar or a mixture of these gases. A particulate gas emitting material such as limestone powder (composed mainly of $CaCO_3$) and magnesite powder (composed mainly of $MgCO_3$), dolomite or the like is added solely or in the form of a mixture into the carrier gas. Carbon powders are added as required to the gas emitting material. The carrier gas and the gas emitting material of controlled mixing ratio is blown into the molten metal through a tuyere provided at the lower portion of the molten steel bath. The gas emitting material is decomposed in the bath to release gas bubbles which act to enhance the stirring power. At the same time, the cooling of the tip end of the tuyere is adjusted by the endothermic reaction during decomposition of the gas emitting material, thereby to protect the tuyere. Thus, these methods simultaneously achieve both of the improvement in the stirring effect and the protection of the tuyere.

More specifically, among the above-mentioned preceding inventions of the same inventors, Japanese Patent Application No. 135668/79 (Laid-Open No. 58915/81) is a method in which a particulate gas emitting material is injected, while Patent Application No. 16979/79 (Laid-Open No. 93812/81) is concerned with a method in which a gas emitting material and carbon powders are injected together with a carrier gas. Further, Patent Application No. 64027/80 relates to a method in which fine particulate powder and powdered carbon are injected into the molten metal bath by means of an inert carrier gas.

At the earlier period of these preceding inventions, the present inventors aimed at enhancing the stirring effect on the molten metal and controlling the cooling effect on the tuyere tip through endothermic reaction during decomposition of a gas emitting material, by blowing a mixture of a carrier gas other than the hydrocarbon and a particulate gas emitting material. The inventors also attempted to increase the heat absorption by adding powdered carbon to the gas emitting material and to enhance the stirring force by CO gas which is generated as a result of a reaction with lime and carbon.

In the later part of the development of these technics, the inventors made an investigation as to the degree of damage of the tuyere used for carrying out these technics, and found that in some cases no metal deposition was taking place at all as shown in FIG. 3 and in other cases a kind of protective layer which acts to prevent the tuyere from direct contact with the molten metal is formed on the end of the tuyere as shown in FIG. 7 to prevent blockage of the tuyere due to deposition of the deposit metal, as well as melting away of the tuyere. This fact encouraged the inventors to a further development of a tuyere protecting method in which a protecting layer is formed around the tuyere by blowing a particulate material together with a carrier gas, instead of the conventional method in which the molten metal is permitted to solidify and deposit to the end of the tuyere due to a cooling of the molten metal around the latter by the cooling effect produced by the cooling gas.

As a result, the inventors have succeeded in developing two kinds of methods which cause a deposition of the protecting material to the tuyere. The first method is to make use of a dual pipe tuyere in such a manner as to inject the refining oxygen gas from the central tuyere while blowing from the outer tuyere a particulate material together with a carrier gas other than oxygen. The second method is to blow a protecting particulate material together with a refining oxygen gas through a single tuyere.

In both of the first and second methods stated above, it was confirmed that a good protecting layer is formed and the entry of the molten metal is effectively prevented even at a blowing velocity lower than sonic speed (330 m/sec) which has been considered as the blockage threshold velocity, by selecting the rate of injection of the protecting material to fall between 0.5 and 10 $kg/cm_2.min$. The applicant filed a request for Patents as Japanese Patent Application No. 45186/80 on these invented methods. These methods, however, proved later to be insufficient in the quantitative analysis concerning kind of the particulate protective material, rate of injection and the chemical composition of the protecting layer to be formed. Then, the present inventors turned to a study for further proceeding the quantitative analysis.

In order to further ensure the protection of the tuyere tip in the decarburization refining furnace, the present inventors intended to make a synthetic and systematic use of various advantageous effect, in addition to the stirring effect performed by the gas bubbles formed by the decomposition of the injected particulate material and the prevention of melting away of the tuyere tip by the absorption of heat from the molten metal around the tuyere as basically achieved by the preceding inventions. The systematic use includes such as the increase of the momentum given by the mixture of the gas and the solid particulate material before the decomposition, effect of shielding from the radiation heat and the prevention of melting away of the tuyere afforded by the deposition of a kind of protective layer on the rim of the end of the tuyere.

SUMMARY OF THE INVENTION

Accordingly, an object of the present invention is to provide a method which can eliminate melting away of the immersed tuyere due to the high temperature of the molten metal, as well as a blockage or narrowing of the immersed tuyere due to entry of the molten metal, while increasing the stirring force and permitting cooling of the molten metal at the tuyere in a decarburization refining furnace.

Another object of the present invention is to provide a method which permits the deposition of a part of the particulate material to the tip end of the immersed tuyere thereby to protect the latter while achieving the above-mentioned various advantageous effects.

Still another object of the present invention is to provide a method in which, besides the stirring of the molten metal and cooling, a layer of composite refractory material, which is fused in oxides such as FeO, $SiO_2$, $MnO_2$ and the like formed by reaction between a refractory particulate material blown into and the injected oxygen, is positively deposited on the tuyere tip to effectively prevent the tuyere from being melted away.

In the aforementioned conventional Q-BOP method in which the whole part of the oxygen is injected from the bottom tuyere, the oxygen gas is enveloped by a jacket gas or liquid or hydrocarbon in order to prevent the melting away of the refractory tuyere material and to cool the tuyere tip by the endothermic reaction during decomposition of the hydrocarbon gas. This method, however, is not recommended because it causes an undesirable rise of [H] in the steel.

The top/bottom blown combined method in which the advantage of the top blown oxygen steel making process (LD process) and the advantages of the bottom blown refining process represented by the Q-BOP method are combined, it is possible to make the advantages of both processes if the rate of injection of the oxidizing gas from the bottom tuyere is adjustable over a wide range to permit the full utilization of the bottom blown refining process. As a matter of fact, however, a flowing back of the molten metal into the bottom tuyere will occur if the rate of injection of the oxidizing gas is decreased down to a level below 50% of the design injection rate. In addition, even if the injection rate is sufficiently large, the spitting will become excessively strong to make the operation practically impossible, if the injection pressure is too high. The present inventors have experienced these facts in the course of developing the aforesaid preceding inventions.

The type of trouble in the immersed tuyere can be sorted into two types according to the kind of the gas injected through the immersed tuyere.

In the case where oxygen is used as the blowing gas, the melting away of the tuyere tip is inevitable unless a suitable countermeasure is taken. In order to avoid this problem, the Q-BOP method employs an injection of a jacket gas of hydrocarbon or a liquid kerosene. It is considered also essential to blow an inert gas such as $N_2$, $CO_2$, argon or the like into the molten metal. These cooling methods, however, have drawbacks as stated before.

To the contrary, in the case where a gas other than oxygen is used as the blowing gas, the problem of the melting away is not so serious. Instead, however, it is often experienced that the immersed tuyere is blocked by molten metal which has entered and solidified to grow in the tuyere, due to lack of combustion heat and lack of stability of the gas flow around the tuyere tip. Hitherto, it has been considered essential to maintain the linear flow speed of the gas at the tuyere tip at a level higher than the sonic speed, in order to prevent the blockage of the tuyere. Namely, as shown in FIG. 1, the jet core is never formed when the linear flow speed is below the sonic speed, so that the molten metal enters the tuyere as indicated by an arrow A to solidify and grow in the tuyere. If the linear flow speed is higher than the sonic speed, a jet core 2 is formed as shown in FIG. 2 to prevent the entry of the molten metal as indicated by an arrow B.

However, if the lower limit of the gas speed is limited to be the sonic speed, the controllable range is impractically narrowed to ±20%, because the upper limit is also limited for various other reasons. This, in turn, impairs the flexibility of control of the stirring force and the refining function undesirably.

FIG. 4 illustrates the mechanism of the conventional method in which a jacket gas is used to shield or jacket the oxygen gas to prevent the melting away of the tuyere. Namely, by injecting a jacket gas 3 from the annular outlet of the double pipe tuyere 5 while injecting oxygen from the central tuyere 6 of the latter, a forced cooling is effected to permit a growth of the deposit metal 9 in the area around the tip end of the tuyere to separate the tuyere from the molten metal. In this method, therefore, it is necessary to suitably adjust the blowing pressure in accordance with a change in the effective injection diameter caused by the growth of the deposit metal, in order to maintain an optimum growth of the deposit metal 9. It is also to be noted that, since the deposit metal blocks the upper part of the tuyere, the cooling gas 3 tends to flow into the molten metal through restricted passages in the porous deposit metal layer, as will be seen from an arrow C in FIG. 6. The adjustment of the blowing pressure of the cooling gas is indispensable also in this case. An inadequate adjustment of the blowing pressure may lead to a danger of complete blocking of the tuyere.

In the even where the metal deposit drps or falls away, the melting of the tuyere will be allowed to proceed until a new layer of deposit metal is formed.

When the cooling gas flows in the direction of arrow A' through the gap between the deposit metal layer 9 and the tuyere refractory material, a spalling of the refractory material tends to occur due to thermal impact.

Thus, there still are pending problems in the method in which the oxygen gas is shielded by a jacket cooling gas.

Under these circumstances, the present invention provides a solution to the problems or troubles taking place at the tuyere tip, such as the blockage of the tuyere due to the use of blowing gas other than oxygen and also the blockage and spalling which take place when the oxygen gas is shielded by other cooling gas, without relying upon the troublesome adjustment of the gas pressure or the like operation, simply by blowing a particulate material together with a carrier gas which may be either the blowing gas or the oxygen gas.

In the series of preceding inventions achieved by the present inventors, the particulate material blown through the immersed tuyere is intended to be decomposed to form gas bubbles which strengthen the stirring effect on the molten metal bath and to cool the molten metal above the tuyere by the endothermic reaction during the decomposition.

The present invention in its first mode makes a positive use of the behaviour of solid particulate material, in addition to the above-mentioned effects of the prior art, i.e. the strengthening or the stirring and cooling of the molten metal. Namely, before the injected particulate material enters deep into the molten metal, i.e. while the particulate material is staying just beneath and above respective tuyeres, only a part of the particles is gasified into bubbles or gasefied only at the surfaces of particles leaving solid cores, while most part of particles remain in the complete state suspended by the carrier gas. The momentum of the jet flow of the gas other than oxygen suspending the solid particulate material is increased due to the presence of the particulate material. The thus increased momentum acts to prevent the entry of molten metal back into the tuyere to eliminate undesirable blockage of the tuyere which tends to occur when a gas containing no oxygen is used as the blowing gas.

According to a mode II A (Embodiment 2) of the invention, when oxygen is blown into the molten metal, a particulate material, preferably a refractory material, is injected together with the jacket gas. This particulate material increases the momentum of the jet flow of gas to offer the same advantage as stated above. In addition, the particulate material suspended in the jacket carrier gas serves to shield the heat radiation. These two effects in combination effectively prevents the blockage of the tuyere due to entry of the molten metal.

A mode II B (Embodiment 3) of the invention is to make efficient use of the behaviour of the particulate material remaining in the solid state in the area just above the tuyere tip. Namely, in the decarburization refining furnace in which oxygen gas is blown into the molten metal through the tuyere, the oxygen gas itself carries suspended refractory particulate material. The particulate material is fused into oxides such as $SiO_2$, $MnO_2$, FeO and the like generated at the reaction point around the tuyere to form a highly heat-resistant mineral refractory deposit layer which coats the tip end portion of the tuyere to effectively prevent the melting away or damage of the latter.

In addition to the modes II A and II B (Embodiments 2 and 3) mentioned above, the invention further provides, as its mode III (Embodiment 4) a blowing method applicable to both the modes II A and II B, in which the rate of supply of the particulate material is increased in a stepped manner in accordance with the progress of the decarburization refining reaction. It was confirmed that this blowing method is quite effective for achieving the stirring and cooling of the molten metal, as well as for the formation of the tuyere protecting layer.

In other words, the invention of mode I includes methods in which oxygen gas is, as a rule, never blown through the immersed tuyere but a gas other than oxygen accompanied by a particulate material is blown into the molten metal.

The invention in accordance with modes II A and II B (Embodiments 2 and 3) include methods in which oxygen gas is blown into the molten metal.

In the mode II A (Embodiment 2) oxygen gas is blown from a central tuyere and jacketed by a jacket gas accompanied by a particulate material and in the mode II B (Embodiment 3), regardless of whether a dual pipe tuyere or a single tuyere is used, only oxygen gas is blown through the bottom tuyere.

The invention of mode III (Embodiments 4) includes methods in which, as mentioned above, the rate of supply of the particulate material is increased in a stepped manner as the decarburization refining reaction progresses.

The mode III (Embodiment 4) is theoretically applicable to both of mode I, modes II A and II B. It was confirmed, however, that the mode III of the invention offers a great advantage particularly when it is applied to the methods of the modes II A and II B, i.e. to the methods of the second and third Embodiments.

These modes of the invention will be more fully understood from the following description of the embodiments and results of the comparison tests, taken in conjunction with the accompanying drawings.

BRIEF DESCRIPTION OF THE INVENTION

DESCRIPTION OF THE PREFERRED EMBODIMENTS

I. Method of protecting immersed tuyere using blowing gas other than oxygen [Mode I (Embodiment 1)]

Figure 1:
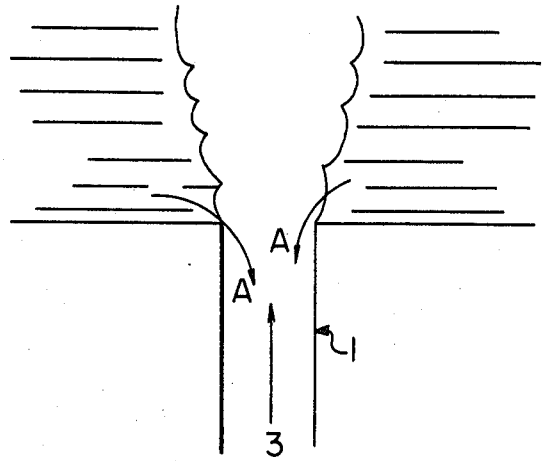
FIGS. 1 and 2 are diagramatic illustration of the behaviour of gas jet flow from a tuyere tip end in conventional decarburization steel refining process, showing particularly the condition of formation of a gas jet core.
Figure 2:
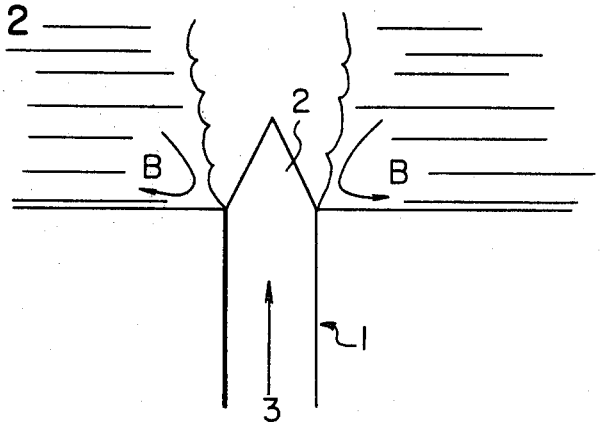
Figure 3:
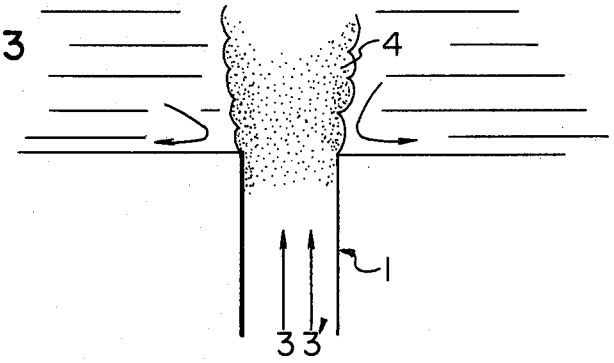
FIG. 3 is a schematic illustration of the behaviour of gas blown from a tuyere in the method in accordance with the invention.

This mode of the invention is characterized by that, in blowing a gas other than oxygen such as $N_2$, Ar, $CO_2$ or the like from a single or a dual pipe tuyere in order to enhance the stirring effect, the gas is accompanied by a particulate material such as limestone powder, magnesite powder (hereafter merely denoted as $MgCO_3$ or $CaCO_3$), dolomite or the like. When the gas is injected accompanying particulate material, the particulate material 3' is blown together with the gas into the molten metal while forming a mixture layer 4 around the inner peripheral edge of the tip end of a tuyere or nozzle, as will be seen from FIG. 3. It will be understood that the momentum of the flowing mixture layer 4 consisting of the particulate material 3' and the gas 3 is much greater than that of the gas alone. The rate of supply of the particulate material is preferably 0.2 to 20 Kg/min per 1 cm of the inner peripheral length of the tuyere or nozzle, i.e. 0.2 to 20 Kg/min.cm, when the depth of the molten metal bath falls between 1.5 and 2.5 m. It was confirmed that, according to this method, the blockage of the nozzle can be avoided even when the flow speed of the gas is decreased to 50 m/sec on the linear speed base.

In order to maintain a good cooling condition for the tuyere bricks, it is preferred to continously increase the rate of supply of the particulate material in accordance with the progress of the refining, i.e. in accordance with the rise of the temperature of the molten metal. The cooling effect, however, saturates when the rate of supply is increased to 20 kg/cm·min and more. The increase of the rate of supply of particulate material, on the other hand, increases the rate of generation of gas by the decomposition of the particulate material to undersirably increase the splashing of the molten metal thereby to seriously hinder the operation.

A rate of supply of the particulate material below 0.2 Kg/cm·min inconveniently reduces the concentration of particulate material in the mixture layer formed around the nozzle edge, to such an extent as to require a linear gas speed higher than the sonic speed as in the case of the conventional process in order to avoid the blockage. Such a small rate of supply of the particulate material therefore, is not preferred.

Table 1 shows Working Examples conducted under conditions to this mode of the invention, with varying conditions of tuyere depth, kind of stirring gas, gas flow speed, kind of particulate material, rate of supply of particulate material and so forth. In order to confirm the effect of supply of the particulate material, comparison tests were conducted without supplying the particulate material.

The detail of conditions of the working examples is shown below.

Working Examples

A pig iron containing 4.3 to 4.5% C, 0.3 to 0.5% Si, 0.45 to 0.5% Mn and the balance being Fe and incidental impurities was refined into a steel containing 0.05 to 1.0% C, less than 0.01% Si, 0.15 to 0.3% Mn and the balance being Fe and impurities, using a 160T top blown oxygen converter. The test was conducted by blowing various stirring gases with various particulate material through immersed tuyeres under various conditions as shown in Table 1. Also, comparison test was conducted without using any particulate material. The degree of blockage or damage of the tuyere was investigated in each case. The rate of top blowing oxygen gas was 25,000 to 30,000 $Nm^3/Hr$. The used tuyere was a single immersed tuyere of 15 mm dia., disposed at the center of the bottom of the furnace or a single refractory lance immersed in the molten metal from the upper surface of the vessel.

The amount of melt away of the tuyere was calculated from the volume of the damaged part of the tuyere and is represented by a numerical value on the basis of the amount of melt down in the reference example No. 1 explained in the description of second mode (mode II) of the invention shown in Table 4, assuming that the amount of melt away in the above-mentioned reference example No. 1 is 100 (hundred).

TABLE 1

| Test No. | * Tuyere depth mm | Stirring gas | ** Gas speed Nm/x | Kind of injected particulate material | Supply rate of particulate material K/cm · min | Condition of tuyere tip blockage | melt away | Remarks |
|---|---|---|---|---|---|---|---|---|
| | | | | Working examples | | | | |
| 1 | 1600 | Ar | 150 | Limestone powder ($CaCO_3$) | 3.0 | None | 15 | Constant injection |
| 2 | 1600 | $CO_2$ | 100 | Limestone plus carbon powder ($CaCO_3$ + C) | 5.0 | | 15 | Constant injection |
| 3 | 1700 | Ar | 70 | Magnesite powder ($MgCO_3$) | 10.0 | | 10 | Constant injection |
| 4 | 1800 | $CO_2$ | 50 | Magnesite powder ($MgCO_3$) | 0.2 | | 20 | Constant injection |
| 5 | 1600 | $CO_2$ | 200 | Limestone powder ($CaCO_3$) | 1.5 | | 10 | Constant injection |
| 6 | 1600 | $CO_2$ | 100 | Limestone powder ($CaCO_3$) | 5-20 | | | Injection rate increased linearly |
| 7 | 1600 | $N_2$ | 100 | Magnesite powder plus carbon powder ($MgCO_3$ + C) | 15 | | 30 | Constant injection |
| | | | | Comparison Test | | | | |
| 1 | 1600 | Ar | 350 | No powder injection | — | Blocking tendency | 45 | Constant injection |

TABLE 1-continued

| Test No. | * Tuyere depth mm | Stirring gas | ** Gas speed Nm/x | Kind of injected particulate material | Supply rate of particulate material K/cm · min | Condition of tuyere tip blockage | melt away | Remarks |
|---|---|---|---|---|---|---|---|---|
| 2 | 1700 | $CO_2$ | 700 | No powder injection | — | Blocking tendency | 50 | |
| 3 | 1700 | $CO_2$ | 300 | No powder injection | — | Complete blocking | 80 | |

Note:
Single tuyeres were used both in working examples and comparison tests.
*Tuyere depth: height difference between molten metal surface and tuyere
** Gas flow speed: apparent gas speed obtained by dividing the gas flow rate in standard state ($Nm^3$/sec) by the cross-sectional area of tuyere tip opening From Table 1, it will be seen that the use of particulate material offers a great advantage in protecting the tuyere.

Namely, in the case where no particulate material is used, the blockage of nozzle is often encountered even when the gas flow speed is still as fast as 350 Nm/sec. In contrast, in the case where the particulate material is used, the blockage is completely avoided provided that the gas flow speed is maintained higher than 50 Nm/sec.

It was also confirmed that, in the event that the supply of the particulate material is interrupted on the mid-way of the blow refining, the blocking of the nozzle occurs immediately. In this mode of the invention, therefore, it is essential to supply the particulate material at a rate of 0.2 Kg/min to 20 Kg/min per 1 cm of inner peripheral length of the nozzle, substantially over the whole period of the refining.

The melting away of the tuyere is accelerated as the decarburization refining proceeds, because the temperature of the molten metal as a whole is increased correspondingly.

In order to cope with this problem, it is advisable to increase the rate of supply of the particulate material in accordance with the proceed of the refining, so that the tuyere is effectively cooled by the absorption of heat by the decomposition of particulate material. For information, the rate of heat absorption is 34500 Cal/mol in the case of limestone ($CaCO_3$).

In order to confirm the effect of control of the rate of supply of the particulate material, a test refining was conducted under the following conditions: (A) supply rate of the particulate material was maintained constant, (B) the supply rate was increased linearly, and (C) no particulate material was supplied as in the case of conventional process, the result of which is shown in Table 2.

In this test, a single bottom tuyere having an inside diameter of 15 mm was used and the temperature change in the area around the tuyere was measured during the decarburization refining.

More specifically, the testing conditions where as follows:

Case A: $CO_2$ gas was used as the carrier gas and blown at a rate of 250 $Nm^3$/hr. Powders of limestone ($CaCO_3$) were supplied as the particulate material at a constant rate of 20 Kg/min (4.2 Kg/min·cm) throughout the period of refining.

Case B: As in the case A, $CO_2$ gas was blown at the rate of 250 $Nm^3$/hr but the rate of supply of limestone ($CaCO_3$) powders was linearly changed from 20 Kg/min (4.2 Kg/min·cm) at the commencement of refining up to 60 Kg/min (12.6 Kg/min·cm) at the end of the refining.

Case C: Tuyere diameter and the condition for supplying carrier gas are the same as those in cases A and B but no particulate material was supplied.

The measurement of the temperature was made by means of a thermocouple embedded at a position spaced 50 mm from the tuyere brick surface and 50 mm from the exterior surface of the nozzle pipe.

TABLE 2

| Cases | Temperature | Refining start | 50% | 80% | Refining completed |
|---|---|---|---|---|---|
| A | metal | 1320° C. | 1480 | 1570 | 1650 |
| | tuyere | 300 | 380 | 450 | 700 |
| B | metal | 1330 | 1415 | 1580 | 1655 |
| | tuyere | 290 | 310 | 315 | 350 |
| C | metal | 1320 | 1480 | 1570 | 1640 |
| | tuyere | 410 | 620 | 810 | 1100 |

The effect of use of particulate material will appear from Table 2 above. Namely, in the cases A and B where the particulate material is supplied, the tuyere is maintained at a lower temperature than in the case C where no particulate material is supplied throughout the refining period, and a protective layer was formed in each of cases A and B. Particularly, it was confirmed that a better effect is obtained by continously increasing the rate of supply of the particulate material from the beginning to the end of the refining period.

The kind of the particulate material to be used differs according to the purpose of refining. Typical examples of these agents are quick lime (CaO), limestone ($CaCO_3$), magnesia ($MgCO_3$), dolomite, powder of refractory brick containing $ZrO_2$, $Al_2O_3$, $SiO_2$, MgO-C and powders of C.

Among these materials, limestone ($CaCO_3$), magnesite ($MgCO_3$), dolomite ($CaCO_3.MgCO_3$) can be used solely or as mixtures, as the aforementioned gas emitting material.

By adding powders of carbon to the particulate material mentioned above, the stirring force is enhanced by the $CO_2$ gas which is generated as a reaction between the limestone and carbon. In addition, the rate of heat absorption is increased to achieve a higher cooling effect.

Gases such as $N_2$, Ar, $CO_2$ or the like can suitably be used as the carrier gas. It is possible to obtain a higher stirring effect and to prevent deposition of excessively large amount of protective layer on the tuyere tip, by adding less than 20 volume % of oxygen gas to the above-mentioned carrier gas.

It is possible to form the protective layer around the tuyere tip to separate the tuyere from the direct contact with the molten metal, by blowing the powders of the gas emitting material, depending on the blowing and refining conditions. The formation of the protective layer will become more effective by adding a refractory material containing ($Al_2O_3$) alumina, silica ($SiO_2$) or the like to the above-mentioned powders of gas emitting material.

In the event that any narrowing of the tuyere tip attributable to excessive deposition of the protective layer is observed during the blowing, it is preferred to inject oxygen intermittently while suspending the blowing by the carrier gas or, alternatively, oxygen and the carrier gas in mixture are blown intermittently, thereby to oxidize and remove the excessive protective layer.

This method of the first mode of the invention is applicable to apparatus which are used for stirring molten metal with a gas other than oxygen, such as a lance for refining molten pig iron, nozzle for bottom blown converter and so forth. Examples of these applications are shown in Table 3 together with comparison tests.

TABLE 3

| Kind of | Nozzle depth | Stirring gas | Gas flow speed | Powder used | Q'ty of powder (Kg) | Time (min.) | Extent of blocking |
|---|---|---|---|---|---|---|---|
| Working Examples | 1600 | $CO_2$ | 100 | Magnesia (MgO) | 0.4 | 17 | None |
| | 1800 | $CO_2$ | 50 | Magnesite ($MgCO_3$) | 0.2 | 16 | None |
| | 1600 | Ar | 50 | Magnesia (MgO) | 0.2 | 16 | None |
| Comparison Test | 1500 | $CO_2$ | 350 | None | None | 17 | None |
| | 1800 | Ar | 250 | Magnesia (MgO) | 0.1 | 17 | Slightly |
| | 1700 | $CO_2$ | 250 | None | None | 13 | Completely blocked |

Note:
Above tests were conducted by using bottom blown oxygen converter.

II. Method of protecting immersed tuyere using oxygen as blowing gas

Using Dual pipe tuyere with annular outlet for blowing jacket gas Mode II A (Embodiment 2)

As is well known, when refining is made by blowing oxygen into molten metal, a heavy wear and damage of the tuyere is observed due to the high temperature caused by heat radiation from the fire point of oxidizing reaction and due to oxidation of the tuyere pipe by the contact of the tuyere with the molten metal and entry of the latter.

As a measure for overcoming this problem, it has been proposed to improve the durability of the tuyere by adopting a dual pipe tuyere having a central tuyere for injecting oxygen and an annular outlet for injecting propane gas, kerosene or the like as a cooling medium.

Figure 4:
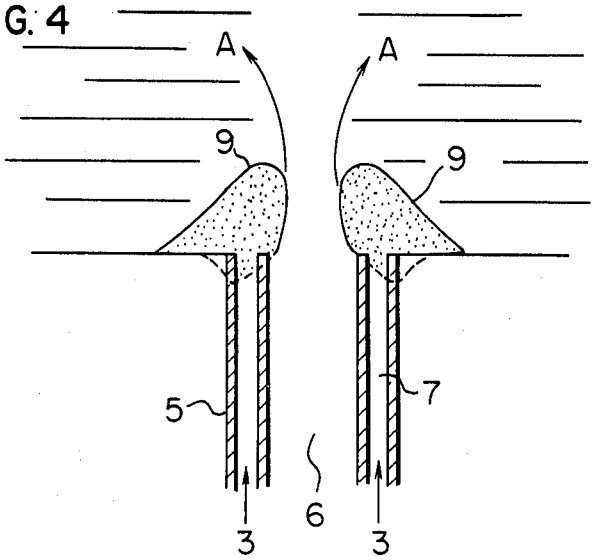
FIG. 4 is a vertical sectional view of a tuyere showing the condition around the tuyere in the conventional refining method.

More specifically, referring to FIG. 4, the tuyere 5 used in this method has a central tuyere 6 for blowing oxygen as indicated by an arrow A and an outer tuyere 7 for blowing a cooling medium as indicated by an arrow 3, so that the metal block solidifies and deposits on the tuyere tip to separate the tuyere tip from the molten metal during the refining thereby to protect the tuyere tip. In this method, therefore, it is strictly required to maintain stable solidification and growth of the deposit metal on the tuyere tip. It is, however, extremely difficult to maintain a steady and constant growth of the deposit metal on the tuyere tip, and suitably control the blowing pressure in accordance with the change of the effective diameter of tuyere caused by the growth of the deposit metal becomes necessary. In addition, in this method, the cooling gas is sometimes obliged to flow into the molten metal only through the fine passages formed in the somewhat porous deposit metal, when such deposit metal blocks the upper part of the tuyere. Thus, it is necessary to suitably control the flowing pressure, otherwise the tuyere may be blocked completely.

The method of this mode of the invention aims to provide sufficient stirring and protecting effects without permitting the deposition of metal on the tuyere tip, thereby to overcome the above-described problems of the prior art.

To this end, according to this mode of the invention, there is provided a method of protecting an immersed double pipe tuyere having a central tuyere for injecting oxygen into a molten metal and an outer tuyere, for blowing a particulate material from the annular outlet between the central and outer tuyeres at a rate of 0.5 to 50 Kg/min per 1 $cm^2$ of the annular outlet, together with a carrier gas other than oxygen, substantially throughout the entire blowing time.

The melting away or damage of the oxygen blowing tuyere is caused by the heat radiated from the fire point at a temperature well reaching 2500° C., as well as by the entry of the molten metal into the tuyere, and is promoted by the oxidation due to the presence of oxygen.

Figure 5:
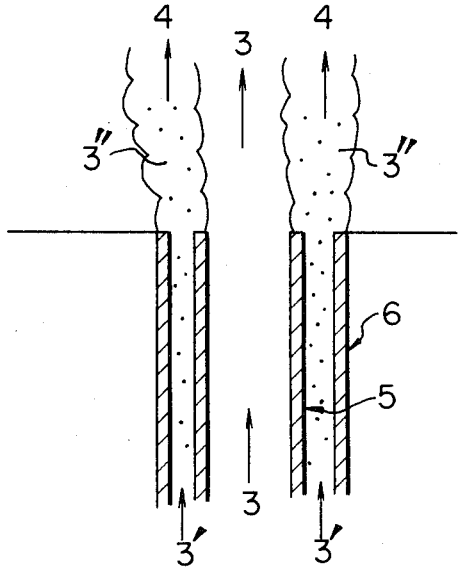
FIG. 5 is a vertical sectional view showing an embodiment of this invention using a dual pipe tuyere.

According to the invention, as will be seen from FIG. 5, a mixture layer (arrow 4) consisting of a particulate material 3'' and a carrier gas 3' other than oxygen is formed to surround the flow of oxygen gas (arrow 3) at the tip end of the dual pipe tuyere 5 consisting of a central tuyere 6 and an outer tuyere 7. This method offers the following advantage in addition to the enhancement of stirring and cooling of molten metal around the tuyere tip end. Namely, the flowing mixture layer 4 can have a larger momentum than that formed by the gas alone, due to the suspension of the particulate material. This increased momentum effectively prevents the entry and deposition of the molten metal in the tuyere and, in some cases, a protective layer instead of a deposit metal is formed on the tuyere tip end to separate the tuyere tip end from the fire point.

The carrier gas injected from the annular outlet may be Ar, $CO_2$, $N_2$, LDG BFG and waste gas (combustion exhaust gas).

Also, various low price refractory powdered material can be used as the particulate material blown into together with the carrier gas from the annular passage. Typical examples of this material are quick lime (CaO), limestone ($CaCO_3$), magnesia (MgO), magnesite ($MgCO_3$), dolomite, and powder of refractory brick containing $SiO_2$, $Al_2O_3$, MgO-C and C.

The particle size of the particulate material is preferably less than 1.0 mm, for attaining a stable blowing.

The rate of supply of the particulate material is the most important factor which rules the state of the gas-powder mixture layer formed around the tuyere tip end. An experiment showed that the rate of supply of the particulate material has to be greater than 0.5 Kg/min per 1 $cm^2$ of sectional area of the annular outlet formed between the central tuyere and the annular outlet. Namely, when this rate of supply was decreased to a level below 0.5 Kg/min, the concentration of the particulate material in the mixture layer is lowered to such an extent as to permit the deposition of metal deposit and melting away of the tuyere tip as in the case of the prior art.

EXAMPLE

A molten pig iron containing 4.3 to 4.5% C, 0.3 to 0.5% Si, 0.45 to 0.5% Mn and the balance being Fe and impurities was refined into a steel containing 0.05 to 0.1% C, less than 0.01% Si, 0.15 to 0.3% Mn and the balance being Fe and impurities, using a 160T top blown oxygen converter. The refining was conducted by blowing various gases into the molten pig iron through an immersed tuyere, together with various particulate material. For the purpose of comparison, refining was conducted also without blowing the particulate material. The extent of blockage and melt away of the immersed tuyere tip end was checked per each case. The rate of supply of the top blow oxygen was selected to be 25,000 to 30,000 $Nm^3$/Hr. The tuyere used was an immersed dual pipe tuyere disposed at the center of the bottom of the tuyere or a single refractory lance immersed in the molten metal from the upper side. The immersed dual pipe tuyere has a central pipe of a diameter of 15 mm with an annular gap of 1 to 3 mm between the central pipe and the annular outlet.

Table 4 shows working examples conducted in accordance with this mode of the invention, with varied flow speed of refining oxygen gas, kind and flow speed of the stirring gas, kind and supply rate of the particulate material. The effect of the powder injection was confirmed through comparison with the result of test refining conducted without applying any powder injection.

TABLE 4

| Test No. | Tuyere depth (mm) | Contral tuyere gas | Contral tuyere gas speed (Nm/s) | Outer tuyere gas | Outer tuyere (Nm/s) | Ratio of flow rate of gas between center tuyere (Vol %) | Powder used | Rate of supply of powder $Kg/cm^2 \cdot min$ | Condition of tuyere tip: blockage | Condition of tuyere tip: melt away |
|---|---|---|---|---|---|---|---|---|---|---|
| | | | | | | Working examples | | | | |
| 1 | 1600 | $O_2$ | 500 | $CO_2$ | 150 | 19 | limestone ($CaCO_3$) | 0.5 | None | 30 |
| 2 | 1600 | $O_2$ | 600 | $CO_2$ | 100 | 12 | magnesite ($MgCO_3$) | 10 | | 25 |
| 3 | 1800 | $O_2$ | 500 | Ar | 100 | 14 | limestone plus carbon powder ($CaCO_3$ + C) | 12 | | 10 |
| 4 | 1800 | $O_2$ | 500 | Ar | 200 | 28 | magnesite ($MgCO_3$) | 30 | | 12 |
| 5 | 1700 | $O_2$ | 600 | Ar | 150 | 18 | limestone ($CaCO_3$) | 50 | | 10 |
| 6 | 1800 | $C_2$ | 450 | $CO_2$ | 200 | 31 | quick lime (CaO) | 1.5 | | 18 |
| 7 | 1200 | $O_2$ | 500 | $CO_2$ | 80 | 11 | magnesia (MgO) | 5 | | 25 |
| 8 | 1600 | $O_2$ | 450 | $N_2$ | 100 | 16 | limestone ($CaCO_3$) | 20 | | 20 |
| | | | | | | Comparison Tests | | | | |
| 1 | 1600 | $O_2$ | 500 | Ar | 120 | 14 | — | — | Blocking tendency in outer tuyere | 100 |
| 2 | 1600 | $O_2$ | 500 | | 110 | 12 | — | — | Blocking tendency in outer tuyere | 45 |

Referring to the working examples Nos. 1 to 8 in comparison with the comparison test, an appreciable tendency of blockage was observed in the comparison tests employing no powder injection, while no blockage was observed at all in the working examples of the invention, despite the flow speeds of both the $O_2$ gas and the stirring gas were maintained at the same level. Also, a distinguishable difference was observed in the extent of melt away of the tuyere.

In this experiment, the rate of supply of the particulate material was increased above 50 $Kg/cm^2 \cdot min$. The effect of the powder injection, however, is saturated at the supply rate of 50 $Kg/cm^2 \cdot min$. The upper limit of the rate of supply of the particulate material, therefore, is determined to be 50 $Kg/cm^2 \cdot min$.

The deposition of metal and melting away of the tuyere were observed as in the case of the prior art, when the supply of the particulate material is stopped on the mid-way of the blowing. The metal deposition on the tuyere, once it occurs, seriously hinders the injection of the particulate agent.

Therefore, in the method of the invention, it is essential that the particulate material is supplied continuously to the outer tuyere substantially throughout the entire blowing time.

The temperature of the molten metal increases as the oxidation refining proceeds, resulting in such a manner as to accelerate the melting away of the tuyere.

To avoid this, it is possible to increase the rate of supply of the particulate material to promote the deposition of the protective layer on the tuyere to further improve the cooling effect on the tuyere thereby to maintain the tuyere in a good condition.

An experiment was conducted to investigate the difference in effect between a case A in which a refractory particulate material was injected at a constant rate and a case B in which the rate of supply of the refractory particulate material was gradually increased from the beginning toward the end of the refining, using a concentric dual pipe tuyere having a central pipe for blowing pure oxygen and an annular outlet for injecting $CO_2$ gas as the stirring and carrier gas for injecting the refractory particulate agent.

The result of this experiment is shown in Table 5.

The rate of blowing of pure oxygen was maintained at a constant level of 450 $Nm^3/hr$, while the stirring $CO_2$ gas was supplied also at a constant rate of 120 $Nm^3/hr$. Lime stone ($CaCO_3$) was used as the refractory particulate material. In the case A, the rate of supply of this material was maintained constant at 15 Kg/min, while, in the case B, the rate was increased gradually from 15 Kg/min at the beginning of the blowing toward 60 Kg/min at the end of the refining. A series of test C was conducted in order to permit a comparison of the method of the invention with the conventional method in which no powder injection was made. The test series C was carried out by blowing propane gas at a rate of 50 $Nm^3/hr$ as the stirring gas, using the same size of the tuyere and oxygen blowing rate as the cases A and B.

Temperatures of the molten metal and the tip end portion of the tuyere were measured by thermocouples at the stages corresponding to 50%, 80% and 100% (completion) of the progress of refining.

The superior effect obtained by the powder injection will be realized from Table 5. It will be noted also that the increase of the powder injection rate in accordance with the progress of the refining is effective in achieving the strong stirring and in suppressing the temperature rise in the area around the tuyere. It was confirmed also that the jet of the gas-powder mixture in the area around the tuyere provides an increase of momentum and shielding from the fire point to effectively promote the formation of the protective deposit.

TABLE 5

| Cases | Temperature | Refining start | Duration of refining 50% | Duration of refining 80% | Refining completed |
|---|---|---|---|---|---|
| A | metal | 1320 | 1475 | 1570 | 1645 |
| | tuyere | 320 | 380 | 430 | 710 |
| B | metal | 1335 | 1490 | 1575 | 1645 |
| | tuyere | 280 | 290 | 295 | 330 |
| C | metal | 1330 | 1480 | 1575 | 1640 |
| | tuyere | 460 | 690 | 840 | 1090 |

The method of this mode of operation of this invention is applicable to the nozzle of immersed lance used for refining of pig iron and steel using oxygen gas, as well as to the nozzle stationarily disposed in decarburization refining furnace.

Table 6 shows the state of the tuyere and melting rate as observed when this method is actually applied to a tuyere, in comparison with those observed in the conventional process employing no powder injection.

More specifically, the blowing was conducted by varying factors such as tuyere depth in the bath, kind of gas injected from the annular outlet of tuyere, kind of particulate material, amount of particulate material, blowing time and so forth.

The tuyere tip end was maintained in the sound state when the refining was conducted in accordance with the method of this mode of the invention, while serious wear or melting of the tuyere was observed when the rate of supply of the particulate material was reduced to a level below 0.4 $Kg/cm^2 \cdot min$.

TABLE 6

| Application | Tuyere depth | Jacket gas | Powder used | Rate of powder supply $Kg/cm^2 \cdot min$ | Time (min) | Condition of tuyere tip | Melting rate of tuyere |
|---|---|---|---|---|---|---|---|
| Converter (bottom blowing nozzle) | 1700 | Ar | $MgCO_3$ | 1.5 | 18 | | 0 |
| | 1800 | $CO_2$ | Quick lime (CaO) | 1.0 | 16 | good | 0 |
| | 1800 | $CO_2$ | Limestone ($CaCO_3$) | 0.5 | 15 | good | 0 |
| | 1700 | $N_2$ | Magnesia (MgO) | 0.6 | 16 | good | 0 |
| | 2000 | $N_2$ | Limestone ($CaCO_3$) | 0.3 | 18 | Slight blockage | 0.1 |
| | 2000 | Ar | Limestone ($CaCO_3$) | 0.4 | 12 | Blockage | 1.3 |
| | 2500 | $CO_2$ | Quick lime (CaO) | 0.4 | 15 | Blockage | 0.5 |
| degassing | 200 | Ar | Quick lime (CaO) | 1.0 | 10 | good | 0 |
| | 300 | $N_2$ | Quick lime (CaO) | 0.8 | 15 | good | 0 |
| | 300 | Ar | Limestone ($CaCO_3$) | 0.5 | 12 | good | 0 |

Method of protecting immersed tuyere by injecting refractory particulate material together with refining oxygen (Mode IIB)

In the oxygen steelmaking process in which oxygen is blown into molten metal in a decarburization refining furnace through an immersed tuyere, heavy wear and breakage of the tuyere tip are usually experienced. To avoid this, a method called Q-BOP method has been proposed in which a dual pipe tuyere is used to inject oxygen from the inner pipe while injecting hydrocarbon in a gaseous or liquid phase through the annular outlet between the inner and outer pipe, thereby to cool the tuyere tip end to prevent the melting of the tuyere. It has been proposed also to blow gases such as $N_2$, Ar, $CO_2$, instead of the hydrocarbon.

Figure 6:
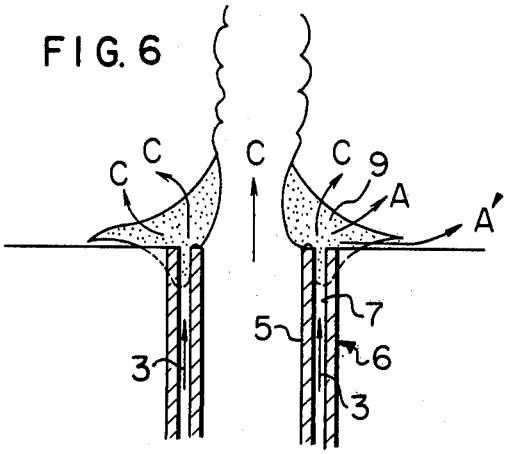
FIG. 6 is a vertical sectional view of a tuyere showing an example of the metal deposition to the tuyere in the conventional process.
Figure 9:
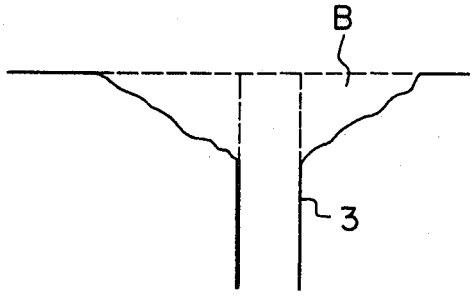
FIG. 9 is a diagramatic illustration of a damaged portion of a tuyere tip.

FIG. 6 illustrates an example of an arrangement for such a method. A dual pipe tuyere 6 has an inner pipe 5 from which oxygen is blown as indicated by an arrow C, and an outer pipe 7 through which a cooling gas 3 is blown to forcibly cool the molten metal to promote a deposition of metal 9 around the tuyere tip end to prevent direct contact between the tuyere and the hot molten metal under refining, thereby to avoid the melting away B of the tuyere tip end as shown in FIG. 9.

This method, however, suffers a problem of difficulty in the control of growth and holding of the deposited metal 9. In addition, it is necessary to suitably adjust the blowing pressure in accordance with the change in the effective diameter of the opening of the inner pipe 5 due to deposition and growth of the metal. Since the metal deposited on the upper part of the tuyere is liable to close the latter, the cooling gas 3 has to flow through fine passages formed in the porous deposit metal into the molten metal as indicated by an arrow A. The control of the pressure of cooling gas is necessitated also from this point of view, for otherwise the tuyere may be blocked completely.

In addition, in some cases, the cooling gas flows through a gap formed between the deposit metal and the surface of the refractory brick of the tuyere as indicated by an arrow A'. In such cases, a spalling of the refractory material tends to occur due to a thermal impact.

Thus, the prior art of the type described have common disadvantages such as lack of stability of the metal deposition on the tuyere tip, difficulty in the control of the blowing gas pressure, blockage of the tuyere due to entry of the molten metal and so forth. In addition, when the hydrocarbon is used as the cooling agent, the [H] content in the product steel is increased undesirably due to decomposition of the hydrocarbon. The use of $N_2$, Ar, $CO_2$ or the like in place of the hydrocarbon also imposes other problems.

These disadvantages or drawbacks of the prior arts have been described also in the Summary of Invention and description of Modes I and II A of the invention in this specification. Namely, the mode I (first Embodiment) of the invention proposes a method in which, in order to eliminate these drawbacks, non-oxidizing gas other than oxygen is injected solely to effect a sufficient stirring and cooling of the molten metal while preventing the blockage of the tuyere. On the other hand, the mode II-A (Embodiment 2) of the invention proposes a method in which a dual pipe tuyere is used such that the oxygen is injected through the central tuyere while another gas acting as a jacket gas is injected together with a particulate material into the molten metal through the annular outlet of the dual pipe tuyere, thereby to eliminate any deposition of metal and blockage of the tuyere.

In contrast to Embodiment 1 and Embodiment 2 of the invention summarized above, this mode II-B (Embodiment 3) of the invention can be carried out in two forms namely a first form in which a single pipe tuyere is used and the refractory particulate material is injected together with the oxygen by which the material is carried, and a second form in which a dual pipe tuyere is used such that a refractory particulate material is blown together with the oxygen gas from the annular outlet while the inner piper emits only oxygen for refining. In both forms, a refractory protective layer is formed on the tuyere tip to protect the latter. Namely, the refractory particulate material suspended by the oxygen gas is fused into the metal oxide or oxides formed as a result of reaction between the blown oxygen and the molten metal to form a coating of a refractory composition to protect the tuyere tip end from melting. This technical idea can never be derived from the prior arts described heretofore.

Figure 7:
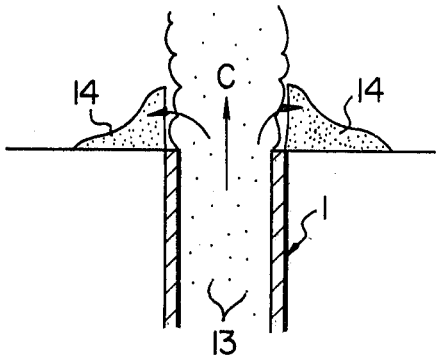
FIGS. 7 and 8 are vertical sectional views of tuyeres showing examples of conditions of protection of the tuyere tip in accordance with the method of the invention.
Figure 8:
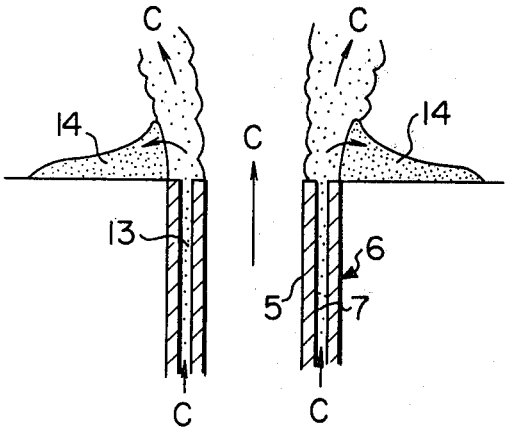

These forms of the invention will be described hereinunder with reference to FIGS. 7 and 8. FIG. 7 shows an example of this Embodiment 3 of the invention in which a refractory particulate material 13 is injected together with the refining oxygen gas as indicated by an arrow C from a single pipe tuyere, to form a protective deposit layer 14 on the tip end of the tuyere. FIG. 8 shows another example employing a dual pipe tuyere 6 having a central pipe 5 and an outer pipe 7. The refining oxygen gas is injected from the central pipe 5 while a refractory particulate material 13 is injected from the outer pipe 7 together with oxygen carrier gas as indicated by an arrow C, thereby to form a protective deposite layer 14 at the tip end of the tuyere as illustrated.

Thus, according to this Embodiment 3 of the invention, a refractory particulate material is blown into the molten metal together with the oxygen gas, so that the refractory particulate material is fused into the oxides such as $SiO_2$, MnO, $FeO_2$ and forth formed at the reaction point near the tuyere, thereby to provide a highly heat-resistant mineral composition which is deposited to coat the tip end of the tuyere to prevent the melting away of the latter.

In order to form the protective deposite layer efficiently on the tuyere tip end by injecting the refractory particulate material, the refractory particulate material is injected preferably at a rate of between 0.5 Kg/min and 50 Kg/min per 1 $cm^2$ of the sectional area of the tuyere opening. An injection rate below 0.5 Kg/min·$cm^2$ deposite layer is delayed undesirably.

For protecting and maintaining the tuyere brick in good condition, it is preferred to continuously and linearly increase the rate of injection of powders, i.e. refractory particulate material, in accordance with the progress of the refining, i.e. in accordance with the rise of the molten metal temperature. However, the protective effect saturates when the injection rate is increased to 50 Kg/$cm^2$·min. A further increase of the injection rate beyond this value does not provide any appreciable increase of the protective effect but, rather, the protective deposit layer becomes excessively thick to hinder the smooth flow of molten metal in the area around the tuyere. In the worst case, a part of the protective deposit layer drops into the tuyere pipe to block the latter.

The rate of injection of the refractory particulate material preferably falls within a range of 0.5 to 50 Kg/min per 1 $cm^2$ of the sectional area of the annular gap between the inner and outer pipes, in the embodiment shown in FIG. 8 in which the refractory particulate material is injected together with oxygen from the outer pipe of the double pipe tuyere. This means that, in the embodiment shown in FIG. 8, the consumption of the refractory particulate material is smaller than that in the embodiment shown in FIG. 7, because the sectional area of the annular gap between two pipes is generally smaller than the sectional area of the opening of the central pipe of the double pipe tuyere.

The protective deposit layer thus aggregated and formed around the tuyere tip end is firmly baked to the latter to ensure the protection of the tuyere while avoiding the undesirable fluctuation of effective diameter of the tuyere which is inevitably caused in the prior art process due to the deposition of the metal to the tuyere tip end.

Various materials can be used as the refractory particulate material, which can form a refractory composition by fusing into the oxides ($SiO_2$, $MnO_2$, FeO etc) formed as a result of reaction between the oxygen and the metallic components in the molten metal. Typical examples of such a material are quick lime (CaO), limestone ($CaCO_3$), magnesia (MgO), magnesite ($MgCO_3$), calcined dolomite, green dolomite, refractory materials containing $Al_2O_3$, $SiO_2$, $ZeO_2$, MgO-C, powders of brick, steel slag or the like containing aforesaid material and the mixtures of these materials.

For restraining or controlling excessive growth of the protective layer, it is possible to use $CaF_2$, $B_2O_3$ or the like as a low melting point material.

To achieve a high stability and rapid reaction, the particle size of the refractory particulate material preferably be less than 1.0 mm.

The method of this embodiment can effectively be used for preventing melting away of the tuyere for various uses such as oxygen blowing tuyere in bottom blown refining of steel, immersed tuyere dipped in molten metal for injecting oxygen to refine the metal, tuyere for use in degassing vessel in contact with molten metal to inject oxygen so as to effect the degassing, and so forth.

Thus, according to this embodiment of the invention, it is possible to securely and firmly form the protective deposite layer on the tuyere tip end to effectively protect the latter.

This also serves to avoid the lowering of the rate of operation of the refining furnace due to frequent renewal of the tuyere, to greatly contribute to the improvement in productivity.

Examples of this embodiment are shown in Tables 7, 8 and 9 in comparison with reference examples. As will be understood from these tables, the method of the invention employing the injection of refractory powder into oxygen gas exhibits, throughout the examples, average melt away indexes of 8 to 15 which is much smaller than that of the test examples ranging between 45 and 70. This tells how the method of this embodiment is effective in protecting the tuyere from melting away.

TABLE 7

Example 1 (double tuyere)

| Examples | Applied to | Location where $O_2$ gas is injected | Carrier $O_2$ gas through annular outlet versus refining ($O_2$) gas through inner pipe (%) |
|---|---|---|---|
| 1 | Bottom blown refining | Vessel bottom depth of bath 1800 | 10.0 |
| 2 | Bottom blown refining | 1500 | 10.0 |
| 3 | Bottom blown refining | 2000 | 10.0 |
| 4 | Bottom blown refining | 1300 | 10.0 |

TABLE 7-continued

Example 1 (double tuyere)

| | | | |
|---|---|---|---|
| 5 | $O_2$ injection for degassing | From lateral side of vessel into molten metal | 8.0 |
| 6 | $O_2$ injection for degassing | From lateral side of vessel into molten metal | 8.0 |
| 7 | $O_2$ injection for degassing | From lateral side of vessel into molten metal | 8.0 |
| 8 | Immersion refining | Dipping in bath 500 | 12.0 12.0 |
| 9 | Immersion refining | 1000 | 12.0 |
| 10 | Immersion refining | 1500 | 12.0 |

| Kind of powder | Particle size | Rate of powder injection | Averaged molten away index |
|---|---|---|---|
| Limestone ($CaCO_3$) | 0.1 | 0.5 Kg/min $cm^2$ | 12 |
| Magnesia (MgO) | 0.3 | 0.7 | 15 |
| Quick line (CaO) | 0.07 | 1.0 | 10 |
| Magnesite ($MgCO_3$) | 0.4 | 3.0 | 15 |
| Calcined dolomite | 0.5 | 10.0 | 8 |
| Green dolomite | 0.05 | 5.0 | 10 |
| Refractory material ($SiO_2$) | 0.9 | 1.0 | 25 |
| Refractory material ($Al_2O_3$) | 0.1 | 4.0 | 20 |
| Refractory material (MgO—C) | Not measured | 7.0 | 13 |
| Refractory material $ZrO_2$ | 0.07 | 0.8 | 15 |

TABLE 8

Example 2 (Single pipe tuyere)

| Examples | Applied to | Location where $O_2$ gas is injected | Kind of powder |
|---|---|---|---|
| 1 | Bottom blown refining | Vessel bottom bath depth 1700 | Limestone ($CaCO_3$) |
| 2 | Bottom blown refining | 200 | Magnesia (MgO) |
| 3 | Bottom blown refining | 1500 | Quickline (CaO) |
| 4 | $O_2$ injection for degassing | From lateral side of vessel into molten metal | Magnesite ($MgCO_3$) |
| 5 | $O_2$ injection for degassing | From lateral side of vessel into molten metal | Calcined dolomite |
| 6 | $O_2$ injection for degassing | From lateral side of vessel into molten metal | Green dolomite |
| 7 | Immersed refining | Tuyere immersed in molten metal 800 | Refractory material containing $BiO_2$ |
| 8 | Immersed refining | Tuyere immersed in molten metal 1500 | Refractory material containing $Al_2O_3$ |
| 9 | Immersed refining | Tuyere immersed in molten metal | Refractory material con- |

TABLE 8-continued

| Example 2 (Single pipe tuyere) | | | |
|---|---|---|---|
| 10 | Immersed refining | 1000 Tuyere immersed in molten metal 1200 | taining MgO—C Refractory material containing $ZrO_2$ |

| Particle size | Rate of powder injection | Averaged melt away index |
|---|---|---|
| 0.1 | 3.0 mg/cm$^2$ | 10 |
| 0.3 | 2.0 | 15 |
| 0.07 | 1.0 | 12 |
| 0.4 | 1.0 | 8 |
| 0.5 | 0.6 | 15 |
| 0.1 | 10.0 | 10 |
| 0.9 | 1.5 | 20 |
| 0.1 | 3.0 | 10 |
| 0.1 | 7.0 | 15 |
| 0.07 | 0.5 | 18 |

TABLE 9

| Reference examples | Applied to | Location where $O_2$ gas is injected | Carrier $O_2$ gas through annular outlet versus refining ($O_2$) gas through inner pipe | |
|---|---|---|---|---|
| 1 | Bottom blown refining | Vessel bottom bath depth 1800 | propane | 11% |
| 2 | Bottom blown refining | Vessel bottom bath depth 1800 | Argon | 10 |
| 3 | $O_2$ injection for depassing | From lateral side of vessel into molten metal | Butane | 11 |
| 4 | $O_2$ injection for depassing | From lateral side of vessel into molten metal | Argon | 8 |
| 5 | Immersion refining | Tuyere immersed in molten metal 1000 | Propane | 11 |
| 6 | Immersion refining | Tuyere immersed in molten metal 2000 | Argon | 15 |

| Kind of powder | Particle size | Rate of powder injection | Averaged melt away index |
|---|---|---|---|
| None | / | / | 45 |
| Limestone ($CaCO_3$) | 0.07 | 0.5 kg/min cm$^2$ | 11 |
| None | / | / | 70 |
| Quick lime (CaO) | 0.1 | 1.0 | 10 |
| None / | / | / | 46 |
| Magnesia | 0.3 | 0.7 | 11 |

TABLE 9-continued (MgO)

Note 1:
The bottom blown refining and the immersion refining were conducted to refine a molten pig iron containing 4.5% C, 0.4% C, 0.4% Si, 0.6% Mn and the balance being Fe and impurities into a steel containing 0.05 to 1.0% C, about 0.01% Si, 0.15 to 0.25% Mn and the balance being Fe and impurities. Average refining time of one heat was about 20 minutes.
Note 2:
The immersion refining was conducted by means of a lance immersed from the upper side into the molten pig iron in a top blown converter.
Note 3:
The average melt away index shows the degree of melt away taking as the reference the extent of melt away observed when argon gas is injected from outer pipe of a double pipe tuyere at a rate of 5 to 15% of oxygen blown from the inner pipe.
Note 4:
The amount of melt away of tuyere was calculated from the volume of molten away portion as shown in FIG. 9.
Note 5:
The rate of injection of the protective material is shown as a rate per unit area (1 cm$^2$) of the cross-section of the tuyere opening.

WORKING EXAMPLE

In this example, pure oxygen gas was blown through the inner pipe of the tuyere, while oxygen gas carrying the refractory particulate material was blown into the metal bath through the annular outlet defined between the inner pipe and the outer pipe in two different manners of supply denoted (A) and (B).

According to the manner (A), particulate material was blown in continulusly at a constant rate, while in the manner (B), particulate material was blown in continuously but at an increasing rate from the beginning toward the end point of oxygen steel making.

The test refinings were conducted as described below.

Pure oxygen was injected through the inner pipe of the tuyere at a flow rate of 450 Nm$^3$/hr, while the oxygen injected through the annular outlet was maintained at 100 Nm$^3$/hr.

Powders of limestone ($CaCO_3$) were selected as refractory materials and in Case (A) 15 Kg/min of stone was blown in at a constant rate of 15 Kg/min, while in Case (B) 15 Kg/min of limestone was injected at the starting of refining and then the amount further injected was continuously increased up to 50 Kg/min toward the end point of the refining operation.

Temperature of the refractory brick at the forward end portion of the tuyere was measured by a thermocouple embedded in the brick at a depth of 50 mm from the surface and 50 mm apart from the outer face of the nozzle pipe.

It can be seen from Table 10 that the injection of such refractory particular material in continuously increasing amounts following the proceeding of the refining is very effective in suppressing the rise in temperature of the tuyere tip end.

TABLE 10

| Case | Temperature of | progress of refining: beginning | 50% | 85% | completed |
|---|---|---|---|---|---|
| (A) | metal bath | 1330° C. | 1485° C. | 1570° C. | 1650° C. |
| | tuyere | 290° C. | 380° C. | 430° C. | 650° C. |
| (B) | metal bath | 1320° C. | 1480° C. | 1575° C. | 1660° C. |
| | tuyere | 300° C. | 310° C. | 310° C. | 330° C. |

A Method in Which Rate of Injection of Particulate material is increased in Stepwise Manner to enhance Stirring Effect and to protect Tuyere [mode III (Embodiment 4)]

This mode of invention is to obviate the problem of weakening of stirring force due to a decrease of C content in accordance with the progress of decarburization refining, in a steel making process in which a gas or gases are blown into molten metal to enhance the stirring effect.

To this end, according to this embodiment, a solid material which is easily decomposed at the temperature of the molten metal and generates a gas is accompanied with the blown gas. The rate of supply of the solid material is increased in a stepwise manner in the later half part of the refining while the rate of blowing of the gas is maintained constant, in such a manner that the sum of the blown gas and the gas generated by the decomposition of the solid material is suitably adjusted in accordance with the decrease of the C content of the molten metal to maintain a sufficient stirring force while protecting the tuyere.

A method of enhancing the stirring and protecting the tip end of the tuyere in accordance with this embodiment will be described hereinunder.

Figure 10:
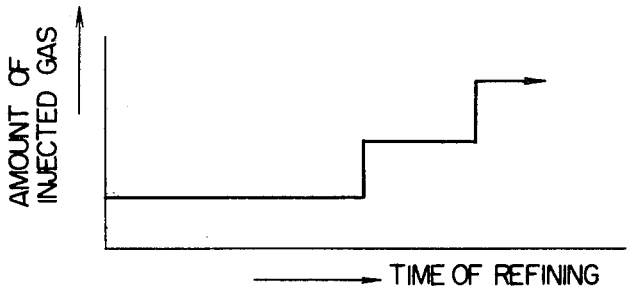
FIG. 10 is a graph showing conventional method of increasing the stirring force by increasing the injection of gas.

As stated before, the CO reaction is vigorous in the beginning and mid period of the refining process, so that the demand for a large stirring force is not so high. However, in the later period of the refining process, the CO reduction becomes less vigorous, so that it is necessary to enhance the stirring force. In order to cope with this demand, in the conventional process, the stirring force is increased by increasing the rate of injection of the gas as shown in FIG. 10.

Figure 11:
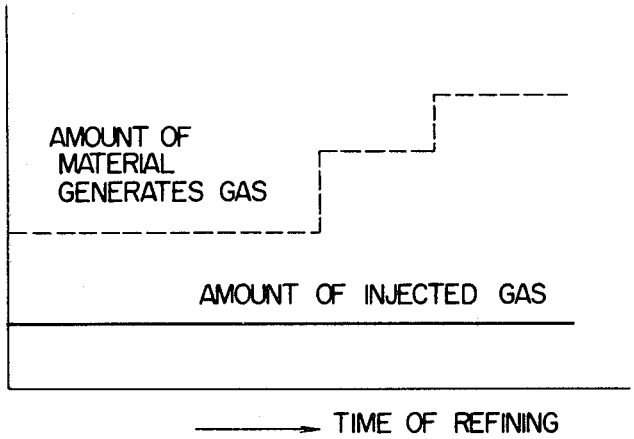
FIG. 11 is a graph showing improved method for increasing total amount of gas by injecting particulate material.

In contrast to the above, according to the present invention, a solid material is injected carried by the blowing gas and, in the latter period of the refining process, only the rate of injection of the solid material is increased while the rate of supply of the gas is maintained constant, to achieve an effective control of the stirring force. The inventors have made various studies to seek the conditions of blowing the gas and solid material for attaining the optimum stirring effect, and have found that the rate of injection of the solid material is preferably adjusted such that the sum of the initially blown gas and the gas generated by the decomposition of the solid material in the late half part (about 50%) of the refining process becomes 1.5 or more times greater than that in the earlier half (about 50%) of the refining process. (See FIG. 11)

For instance, assuming that limestone ($CaCO_3$) is used as the solid material, the amount of gas generated by decomposition of this material is about 0.22 $Nm^3$ per 1 Kg as stoichiometrically shown by the following equation:

Amount of $CO_2$ generated from k Kg of limestone =

$$\frac{1.0}{100} \times 22.4 = 0.224\ Nm^3$$

Thus, the desired stirring force can be obtained by injecting limestone at a rate of less than 1 Kg per 1 $Nm^3$ of the blown gas in the earlier half period of the refining process and then further injecting limestone ($CaCO_3$) at a rate of more than 5 Kg per 1 $Nm^3$ of the blown gas while maintaining the rate of the gas unchanged.

In order to avoid various problems such as blockage of the nozzle and to ensure a smooth blowing, injection of the solid material is preferably to be made over the entire period of the refining. Also, for obtaining a smooth decomposition reaction, the particulate solid material is preferably prepared in a particle sizes less than 1 mm.

In the method of this embodiment of the invention, the gas blown from the bottom of the molten metal is, for example, pure oxygen, $N_2$, Ar, $CO_2$ or mixture thereof.

Also, limestone ($CaCO_3$), magnesite ($MgCO_3$), green dolomite ($CaCO_3$–$MgCO_3$) or the like can be used as the solid material.

These materials easily make the following decomposition reaction and generate $CO_2$ gas which contributes to the stirring of the molten metal.

$$CaCO_3 \rightarrow CaO + CO_2$$

$$MgCO_3 \rightarrow MgO + CO_2$$

It is quite effective to increase the gas volume through the following reaction, by adding powdered carbon to this solid material.

$$CO_2 + C \rightarrow 2CO$$

Working examples of this embodiment will be described hereinunder.

Using a 160 T top blown oxygen converter with four tuyeres arranged at the bottom of the converter, a combined top and bottom blown oxygen refining was conducted by injecting particulate limestone ($CaCO_3$), magnesite ($MgCO_3$) and green dolomite from the bottom tuyeres together with the oxygen gas, and the result of the refining was recorded and examined.

The main raw material used for this refining was 130 Tons of molten pig iron and 40 Tons of scrap iron. The molten pig iron contained 4.2% C, 0.35% Si, 0.55% Mn, 0.100% P, 0.015% S and 0.0040% N, and the temperature of molten pig iron was 1350° C.

The rate of supply of the pure oxygen from the top lance was constantly maintained at 30000 $Nm^3$/hr.

The patterns of injection of the oxygen and the solid material from the bottom tuyeres were selected such that the sums of the amount of the pure oxygen blown and the amount of gas generated by decomposition of the solid material in all heat cycles are equal. The refining time of each heat cycle was about 18 minutes.

Examples of the injection pattern are shown below.

EXAMPLE 1

Pure oxygen was blown from the bottom tuyeres at a constant rate of 750 $Nm^3$/hr, while the rate of injection of the limestone ($CaCO_3$) powder was 500 Kg/hr from the start of the refining until 50% of the whole refining period, then it was added 2500 Kg/hr in the period between 50 and 85% of the whole refining period and finally 7500 Kg/hr in the last part, i.e. 85% to 100% (completion of the refining) of the whole refining period. In this case, the amount of the blown pure oxygen per 1 ton of the steel was 1.4 $Nm^3$ while the amount of $CO_2$ generated from limestone ($CaCO_3$) was 0.9 $Nm^3$. It is also understood that the rate of supply of the gas in the 50 to 85% of refining is 1.5 times as large as that in the earlier half part, i.e. 0 to 50% of refining. Also, the rate of supply of the gas in the 85 to 100% period is about 3 times as large as the beginning half part of the refining.

EXAMPLE 2

$CO_2$ gas was blown from the bottom tuyeres at a constant rate of 750 $Nm^3$/hr, together with varied rate of powdered magnesite ($MgCO_3$). The rate of injection of magnesite was 400 Kg/hr in the earlier half part of the refining and 3400 Kg/hr in the late half part of the refining. In this case, the amount of blown $CO_2$ gas per 1 ton of steel was 1.4 $Nm^3$, while the amount of $CO_2$ gas generated from magnesite ($MgCO_3$) was 0.9 $Nm^3$. Thus, the sum of $CO_2$ gas supplied per 1 ton of steel was 2.3 $Nm^3$. It will be understood that the rate of supply of the gas in the later half period is about 2 times as large as that supplied in the earlier half of refining.

For a comparison purpose, refining was conducted as two comparison tests in the following patterns, under the same conditions of top blowing condition, pig iron to be refined and subsidiary raw material as used in the above-mentioned Examples 1 and 2.

Comparison test 1

$N_2$ gas was blown from the bottom tuyere at a varying rate, 1000 $Nm^3$/hr from the beginning to 50% of the whole refining period, 1500 $Nm^3$/hr between 50 and 85% of the whole refining period and 2200 $Nm^3$/hr from 85% to 100%, i.e. the end, of the whole refining period. The amount of blown $N_2$ gas was 2.3 $Nm^3$ per ton of steel.

Comparison test 2

Pure oxygen and limestone powder were injected from the bottom tuyeres at constant rates of 750 $Nm^3$/hr and 2250 Kg/hr, respectively. The amount of oxygen gas supplied per 1 ton of steel was 1.4 $Nm^3$, while the amount of the limestone was 0.9 $Nm^3$ per 1 ton of steel. Thus, the sum of the gas was 2.3 $Nm^3$.

The results of refining conducted with above-mentioned injecting patterns are shown in Table 10 for evaluating the effect of stirring of the molten metal.

TABLE 11

| | CaO unit (Kg/T) | Blowing temp (°C.) | Blow-out C % | Blow-out Mn % | Blow-out P % | Blow-out N % | T, Fe contents in slag % | Amount of recovered LDG gas ($Nm^3$/T) |
|---|---|---|---|---|---|---|---|---|
| Example 1 | 37 | 1620 | 0.053 | 0.23 | 0.009 | 0.0008 | 13.0 | +1.5 |
| Example 2 | 38 | 1625 | 0.058 | 0.24 | 0.008 | 0.0008 | 12.8 | +4.2 |
| Comparison Test 1 | 40 | 1620 | 0.055 | 0.22 | 0.009 | 0.032 | 13.0 | |
| Comparison Test 2 | 37 | 1620 | 0.048 | 0.18 | 0.014 | 0.0013 | 16.5 | +1.4 |

In the injection patterns in accordance with this embodiment, the rate of supply of the solid material is increased in the later half part of the refining period to control the rate of generating of the gas from the solid material, while maintaining the gas blowing rate substantially constant, in such a manner that the amount of stirring gas obtained in the later half period is materially 1.5 or more times as large as that obtained in the earlier half period of refining. It will be seen from Table 10 that the method of the invention provides a stronger stirring effect on the molten metal and slag, while achieving a higher dephosphorization effect. Also, a high blow-out Mn and small total Fe contents in the slag are noted.

The solid material used in the method of this embodiment not only provides the stirring effect through generation of gas but also is effective in that the CaO or MgO generated as a result of the decomposition effectively serves as the slag making agent in the refining of iron into steel, and permits the reduction of total amount of CaO and/or MgO usually injected for the purpose of dephosphorization, desulfurization and protection of bricks. The generated $CO_2$ gas can be recovered for further use through a reaction with the carbon in the steel as expressed by the following reaction.

$$CO_2 + C \rightarrow 2CO$$

Thus, this embodiment of the invention offers various advantages such as saving of energy, facilitating refining and so forth.

Furthermore, in the method of this embodiment of the invention, the solid material used as the source of the stirring gas serves also as a flux for refining, to permit lowering of consumption of the green lime, dolomite or the like. The method of this embodiment is advantageous also from the economical point of view, because the generated gas can be recovered and reused as a fuel gas having a high calorific value.

The method of this embodiment is applicable not only to the described bottom-blown converter refining process but also to a refining process making use of an immersed lance having a gas injection nozzle.

What is claimed is:

1. A method of preventing damage to an immersed tuyere for use in an oxygen steel making furnace used for a decarburization refining process, comprising the steps of:

forming a gas-powder mixture consisting of a gas emitting particulate material of an amount sufficient to generate a gas for stirring a molten metal bath and a carrier gas other than oxygen;

blowing said gas-powder mixture into said molten metal bath through said immersed tuyere to form a layer of said gas-powder mixture of an increased momentum on the inner peripheral rim and immediately above the nozzle of said immersed tuyere; and cooling the molten metal around the tip end of said immersed tuyere by the absorption of heat caused by the endothermic decomposition reaction of said particulate material, while, stirring said molten metal bath by the combined effect of said carrier gas jet, gas generated through said decomposition reaction and said particulate material remaining undecomposed;

whereby the entry of said molten metal into said tip end of said immersed tuyere is prevented by the combined effect of the increased momentum, cooling and stirring effect, to prevent clogging, blockage and/or wear of said tip end of said immersed tuyere.

2. A method as claim in claim 1, wherein said gas emitting particulate material is selected from the group consisting of limestone powder ($CaCO_3$) magnesite powder ($MgCO_3$), dolomite powder and mixtures thereof.

3. A method as claimed in claim 2, wherein a powder mixture prepared by adding powdered carbon to said gas emitting particulate material is mixed and blown together with said carrier gas.

4. A method as claimed in claim 1, wherein said carrier gas is at least one selected from the group consisting of $N_2$, Ar and $CO_2$ or a mixture thereof.

5. A method as claimed in claim 1, wherein said carrier gas is at least one selected from the group consisting of $N_2$, Ar, $CO_2$, LDG BFG, waste gas (combustion exhaust gas) or a mixture thereof.

6. A method as claimed in claim 1, wherein less than 20% of oxygen is added to said carrier gas.

7. A method as claimed in claim 1, wherein said particulate material is blown into said gas-powder mixture throughout the entire duration of refining at a substantially constant rate of 0.2 to 20 Kg/min per 1 cm of the circumferential length of said tuyere.

8. A method as claimed in claim 1, wherein, in the event that a narrowing or a blocking tendency is observed in said immersed tuyere, oxygen gas is injected intermittently in place of or in addition to said carrier gas thereby to melt and remove excessive deposition of metal deposited on the tip end of said immersed tuyere.

9. A method as claimed in claim 1, 6 or 7, wherein the rate of injection of said gas emitting particulate agent is linearly increased in accordance with the decrease of carbon content in said molten metal as said decarburization refining proceeds on.

10. A method as claimed in claim 1, 6 or 7, wherein the rate of injection of said gas emitting particulate material is increased in a stepwise manner in accordance with the decrease of carbon content in said molten metal as said decarburization refining proceeds.

11. A method as claimed in claim 1, 6, 7, or 8, wherein said gas-powder mixture is injected through a single pipe tuyere.

12. A method as claimed in claim 1, 6, 7, or 8, wherein said gas-powder mixture is injected through an annular outlet of a double pipe tuyere.

13. A method of preventing damage to an immersed tuyere for use in an oxygen steel making furnace for a decarburization refining process, comprising the steps of:

blowing pure oxygen gas from the inner pipe of a dual pipe tuyere;

injecting a gas-powder mixture from the annular outlet between the inner and outer pipes of said dual pipe tuyere substantially throughout the refining at a rate of more than 0.5 Kg/min per 1 $cm^2$ of cross-sectional area of said annular outlet, said gas-powder mixture consisting of a jacket gas other than oxygen and a particulate material suitable for flowing into molten metal bath; and forming the layer of said gas-powder mixture on the inner peripheral rim of the nozzle of said tuyere and just above said tuyere to increase the momentum of the jet flow in the area around said tuyere and to increase the effect of shielding from the radiation heat, while cooling the tip end of said tuyere and molten metal therearound by said gas-powder mixture and stirring said molten metal bath by said pure oxygen and by said gas-powder mixture;

whereby the entry of molten metal into the tip end of said immersed tuyere is avoided and clogging, blockage, wear and breakage of tip end of said tuyere can be prevented.

14. A method as claimed in claim 13, wherein the rate of injection of said particulate material is selected to fall between 0.5 and 50 Kg/min per 1 $cm^2$ of cross-sectional area of said annular outlet.

15. A method as claimed in claim 13 or 14, wherein the rate of injection of said gas-powder mixture is linearly increased from the beginning upto the end of the refining.

16. A method as claimed in claim 13 or 14, wherein the rate of injection of said gas-powder mixture is increased in a stepwise manner from the beginning upto the end of the refining.

17. A method as claimed in claim 13 or 14, wherein said particulate material is at least one selected from the group consisting of quick lime, limestone, magnesia, magnesite, dolomite, refractory materials containing above material and $Al_2O_3$, MgO-C and $ZrO_2$ or the mixture thereof or a composition formed by adding powdered carbon to said selected material or said mixture.

18. A method as claimed in claim 13 or 14, wherein the kind, injection rate and injecting condition of said particulate material of said gas-powder mixture are so selected as to form protective deposit layer on the tip end of said tuyere for preventing said tip end from directly contacting said molten metal.

19. A method as claimed in claim 13 or 14, wherein, in the event a narrowing or blocking tendency in said tuyere is sensed during the refining, oxygen gas is blown intermittently in place of or in addition to said jacket gas thereby to melt and remove the excessive protective deposition from said tip end of said tuyere.

20. A method as claimed in claim 13 or 14, wherein said jacket gas is one selected from a group consisting of Ar, $CO_2$, $N_2$, LDG, BFG, waste gas combustion exhaust gas and a mixture thereof.

21. A method of preventing damage to an immersed tuyere for use in an oxygen steel making furnace for decarburization refining process, comprising the steps of:

blowing refining pure oxygen from said tuyere; blowing an oxygen-powder mixture substantially throughout the refining, said oxygen-powder mixture being composed of said refining pure oxygen serving as a carrier gas for blowing a refractory particulate material;

fusing said refractory particulate material into the oxides formed in the molten metal bath so as to form a composite refractory deposit;

said refractory structure being coagulated and coated to the tip end of said immersed tuyere to form a refractory protective deposit layer to separate said tip tuyere from direct contact with molten metal;

thereby to prevent melting away of said tip end of said tuyere while maintaining sufficient stirring effect on said molten metal.

22. A method as claimed in claim 21, wherein said refractory particulate material is selected from a group consisting of quick lime, limestone, magnesia, magnesite calcined dolomite, green dolomite, powder of refractory brick containing $Al_2O_3$, $ZrO_2$, MgO-C steel slag or a mixture thereof.

23. A method as claimed in claim 21 or 22, wherein said refractory particulate material is injected at a rate greater than 0.5 Kg/min per 1 $cm^2$ of cross-sectional area of the tuyere opening.

24. A method as claimed in claim 21 or 22, wherein said refractory particulate material is injected at a rate ranging between 0.5 and 50 Kg/min per 1 $cm^2$ of cross-sectional area of the tuyere opening.

25. A method as claimed in claim 21 or 24, wherein said refractory particulate material is injected at a continuously increasing rate substantially throughout the refining.

26. A method as claimed in claim 21 or 12, wherein the rate of injection of said refractory particulate material is linearly increased from the beginning up to the end of the refining process.

27. A method as claimed in claim 21 or 22, wherein the rate of injection of said refractory particulate material is increased in a stepwise manner from the beginning up to the end of the refining process.

28. A method as claimed in claim 21 or 22, wherein a single pipe tuyere is used and said pure oxygen is blown also as a carrier gas for injecting said refractory particulate material.

29. A method as claimed in claim 21 or 22, wherein a dual pipe tuyere is used in such a way that pure oxygen alone is blown from the inner pipe while a mixture of pure oxygen as the carrier gas and said refractory particulate material are injected from the annular outlet between the inner and outer pipes of said dual pipe tuyere.

30. A method as claimed in claim 21 or 22, wherein an excessive deposition of protective deposit layer is prevented by an addition of powders of a low-melting point material such as $B_2O_3$ or the like.

31. A method of preventing lowering of stirring force and damage to an immersed tuyere for use in an oxygen steel making furnace for decarburization refining process, comprising the steps of:

blowing a gas from said immersed tuyere throughout the entire refining; and injecting a particulate solid material making use of said gas as a carrier gas at a rate increasing from the beginning upto the end of said refining process, said particulate solid material being capable of generating a gas upon decomposition at the temperature of the molten metal, the rate of injection of said particulate solid material being adjusted such that the sum of the blown gas and the gas generated by decomposition of said particulate solid material per unit time in the later half part is 1.5 times or greater as large as that in the earlier half part of the refining;

whereby the reduction of the stirring force due to decrease of the carbon content in said molten metal is compensated for by increase of the sum of said gases while preventing damage to the tip end of said tuyere.

32. A method as claimed in claim 31, wherein said particulate solid material is selected from the group consisting of limestone ($CaCO_3$), magnesite ($MgCO_3$), green dolomite ($CaCO_3.MgCO_3$) or a mixture thereof.

33. A method as claimed in claim 31, wherein said blown gas is selected from the group consisting of pure oxygen, $N_2$, Ar, $CO_2$ or a mixture thereof.

34. A method as claimed in claim 31, wherein said blown gas is selected from the group consisting of pure oxygen, $N_2$, Ar, $CO_2$, LDG, BFG waste gas, combustion exhaust gas and a mixture thereof.

35. A method as claimed in claim 31, wherein at least one of $N_2$, Ar, $CO_2$ or a mixture thereof is used as said carrier gas, and said particulate solid material is formed by adding powdered carbon to at least one of limestone ($CaCO_3$), magnesite ($MgCO_3$) and green dolomite or a mixture hereof.

* * * * *